US005104099A

United States Patent [19]

Long

[11] Patent Number: 5,104,099

[45] Date of Patent: Apr. 14, 1992

[54] SPRING BEDDING PRODUCT

[75] Inventor: Thomas P. Long, Carthage, Mo.

[73] Assignee: Leggett & Platt, Incorporated, Carthage, Mo.

[21] Appl. No.: 516,069

[22] Filed: Apr. 27, 1990

[51] Int. Cl.[5] ..... F16F 3/04

[52] U.S. Cl. ..... 267/91; 5/256; 267/103

[58] Field of Search ..... 267/103, 91; 5/248, 5/256, 475

[56] References Cited

U.S. PATENT DOCUMENTS

| | | | |
|---|---|---|---|
| 258,595 | 5/1882 | Phillips | 267/91 |
| 4,609,180 | 9/1986 | Thoenen | 267/103 |
| 4,905,333 | 3/1990 | Scott | 5/475 |
| 4,960,267 | 10/1990 | Scott | 5/248 |
| 4,972,536 | 11/1990 | Scott | 5/268 |

FOREIGN PATENT DOCUMENTS

| | | |
|---|---|---|
| 1104884 | 3/1968 | United Kingdom . |
| 2143731B | 11/1986 | United Kingdom . |

*Primary Examiner*—Robert J. Oberleitner
*Assistant Examiner*—Lee W. Young
*Attorney, Agent, or Firm*—Wood, Herron & Evans

[57] ABSTRACT

A spring interior comprising a plurality of longitudinally extending bands of springs disposed side by side and connected together by helical lacing wires in the top and bottom faces of the bands. Each band of springs comprises a single length of wire formed into a plurality of substantially vertical coil springs interconnected by interconnecting segments of wire located alternately in the top and bottom faces of the bands. The coil springs of each row are interconnected by interconnecting segments with the adjacent coils of the same row. The interconnecting segments comprise a planar bridging portion which extend generally lengthwise of the row and arcuate end sections which extend generally transversely of the row. The arcuate end sections are planar and connect the coil springs to the bridging portions of the interconnecting segments. The arcuate end sections are of approximately the same radius as the coil springs to which the arcuate end sections are connected.

8 Claims, 4 Drawing Sheets

SPRING BEDDING PRODUCT

FIELD OF THE INVENTION

This invention relates to spring interiors, and specifically to spring interiors for bedding products, such as mattresses and the like.

BACKGROUND OF THE INVENTION

A known form of spring interior comprises a plurality of longitudinally extending bands of springs disposed side by side and connected together by helical wires which extend transversely of the bands and embrace portions of the bands. Several kinds of bands of springs have been proposed for incorporation in spring interiors. One kind of band, which is the subject of British Patent No. 1,104,884, will hereinafter be referred to as a band of interlocked or interlaced springs. It comprises a single length of spring wire shaped to form a plurality of individual coil springs arranged in a row, one end turn of each coil spring lying adjacent to a top face of the band and the other end turn of each coil spring lying adjacent to a bottom face of the band, each coil spring being of a rotational hand opposite to the rotation hand of the adjacent coils immediately before and after it in the row, and being joined to the adjacent coil springs by a pair of interconnecting segments of wire integral with the coil springs. One of the pair of interconnecting segments is located in the bottom face of the band, and the other of the pair of interconnecting segments is located in the top face of the band. Each interconnecting segment comprises a bridging portion between adjacent coils, which bridging portion extends generally lengthwise of the row, and end sections connecting the bridging portion to the adjacent coils, which end sections extend generally transversely of the rows.

When bands of interlocked springs of the type described hereinabove are assembled to form a spring interior, they are disposed side by side and interconnected by helical lacing wires, some of which lie in the top face of the spring interior and others of which lie in the bottom face thereof, the top and bottom faces of the spring interior being the faces defined by the top and bottom faces of the bands incorporated in the spring interior. Each helical wire extends across the bands of springs and embraces portions of wires of the bands that extend transversely of the bands from the ends of the bridging portions of the links. In the top face of the spring interior the helical wires are disposed at uniform intervals along the bands of springs, the arrangement being such that there are two springs disposed in the interval between each helical wire and the next. There is a similar arrangement in the bottom face of the spring interior.

In this description of the invention there are references to faces of bands of springs and of spring interiors. As the bands of springs and spring interiors are, of course, of open-work or skeletal form, the term "face" must be understood as referring to an imaginary surface defined by the relevant parts of the bands or spring interiors. Furthermore, as the wires and helical wires are of finite width or thickness and as they sometimes overlap each other, the term "face" cannot be understood as having a strictly geometrical meaning. Nevertheless, as the faces concerned are relatively extensive and are of flat shape, their locations can in practice be determined without difficulty or ambiguity.

It is customary for a bedding spring interior to be incorporated in an upholstered article. In such an article at least one of the main faces of the spring interior (that is the top and bottom faces thereof) is covered by a layer or layers of padding. This in turn is covered by a cover made of sheet material, such as ticking or upholstery fabric.

A primary cost of producing a bedding spring interior is the cost of the wire used to create the bands of springs and their requisite connecting and supporting structures. Therefore, it can generally be said that by reducing the quantity of wire used in the bedding spring structure, one will reduce the cost of producing such a structure. Furthermore, reduction in the production cost of a bedding spring interior will be realized if one can speed up the production process and simplify the manufacturing machinery required to produce the spring interior.

It has therefore been an objective of this invention to provide an improved bedding spring interior made from bands of interlocked springs which reduces the amount of wire needed per unit and at the same time reduces the amount of time required to produce the unit but without sacrificing firmness or durability of the unit.

Still another objective of this invention has been to provide an improved spring interior made from bands of interlocked coils which facilitates production without requiring more complicated machinery and, in fact, which may be made on less complicated and expensive machinery than is currently used in existing production lines.

SUMMARY OF THE INVENTION

The invention of this application which achieves these objectives comprises a spring interior having a plurality of longitudinally extending bands of interlocked or interlaced coil springs wherein the bands are disposed side by side so that their top faces lie in a top main face of the spring interior and their bottom faces lie in a bottom main face of the spring interior. The adjacent springs of each band are connected by interconnecting segments which are integral with the coil springs. These interconnecting segments are made up of a bridging portion which extends generally lengthwise between the coil springs and end sections which extend transversely of the rows from opposite ends of each bridging portion, which end sections connect the bridging portions to the coil springs. These end sections are arcuate sections of wire which extend from the springs in the top and bottom planes of the spring interior maintaining approximately the same radius as the coils. The bands of springs are interconnected by helical wires lying in the top and bottom faces of the bands and extending across the bands with each helical wire embracing portions of the arcuate end sections that extend transversely of the bands. In the prior art, as for example, in the above-identified British Patent No. 1,104,884, the intersection of the coil springs with the end sections of the interconnecting segments is well defined as the coil springs are curved and the end sections of the interconnecting segment are generally straight. However, in this invention, the end sections of the interconnecting segments continue with the same radius from the top and bottom faces of the interior into the coil springs. As a result, the planar end sections of the bridging portion appear to be integral portions of the coil springs.

The primary advantage of the invention of this application is that it replaces the straight or substantially straight end sections of the bridging portions of the bands of springs with curved arcuate end sections of approximately the same radius as the coils to which the end sections are connected. By maintaining the radius and curved shape of the coil springs throughout the planar end sections of the interconnecting segments until the planar end sections intersect with the bridging section, the arcuate end section rounds what was once a corner, resulting in approximately a four percent reduction in the amount of wire needed per unit. Furthermore, the new geometry allows an increase in production speed with more simplified manufacturing machinery. It also allows an increase in coil density if desired because of the smaller head sizes at the top of the coil.

These and other objects and advantages of this invention will become more readily apparent from the following description of the drawings in which.

Figure 1:
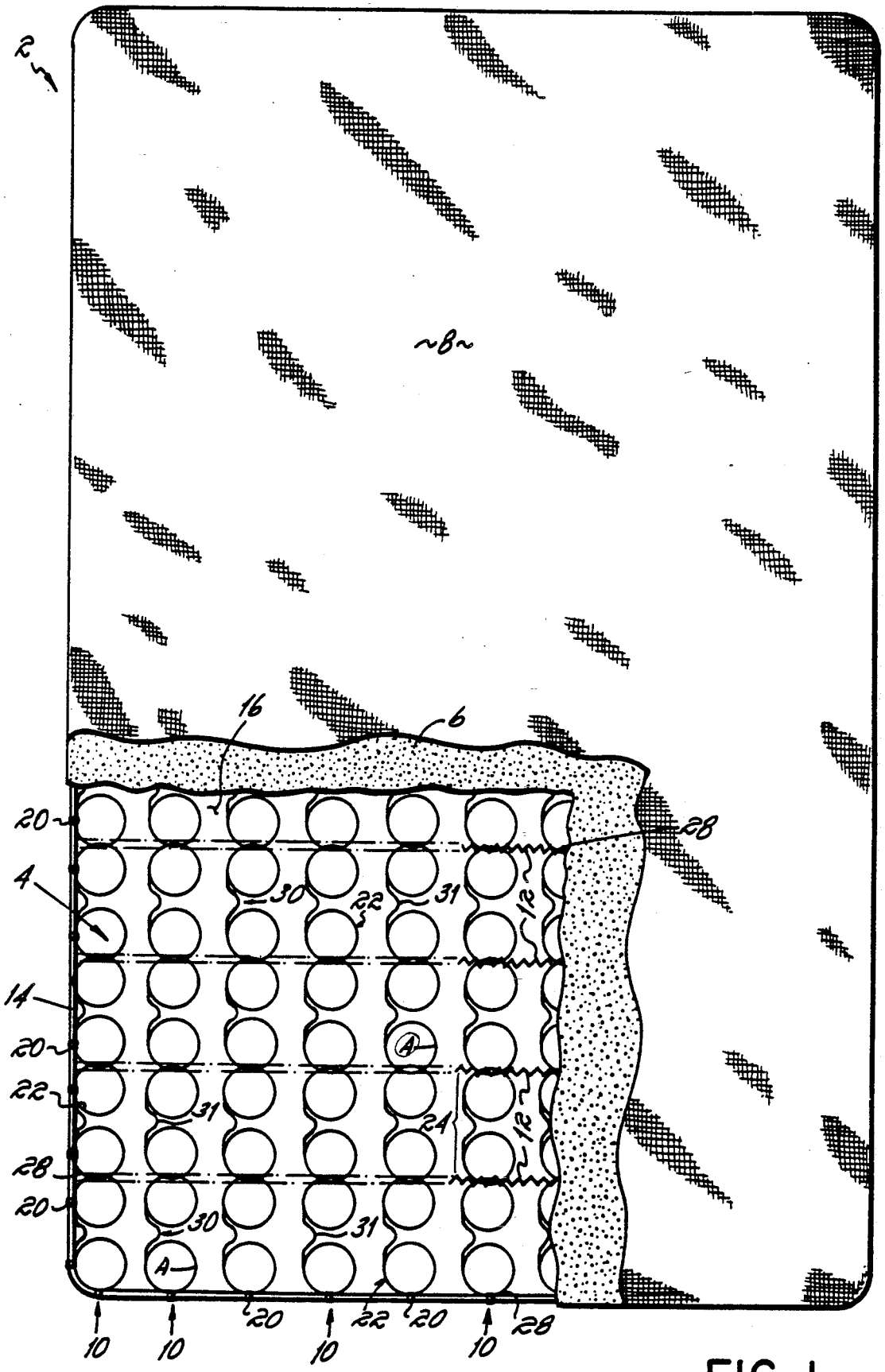
FIG. 1 is a top plan view, partially broken away, of a mattress incorporating the invention of this application.
Figure 2:
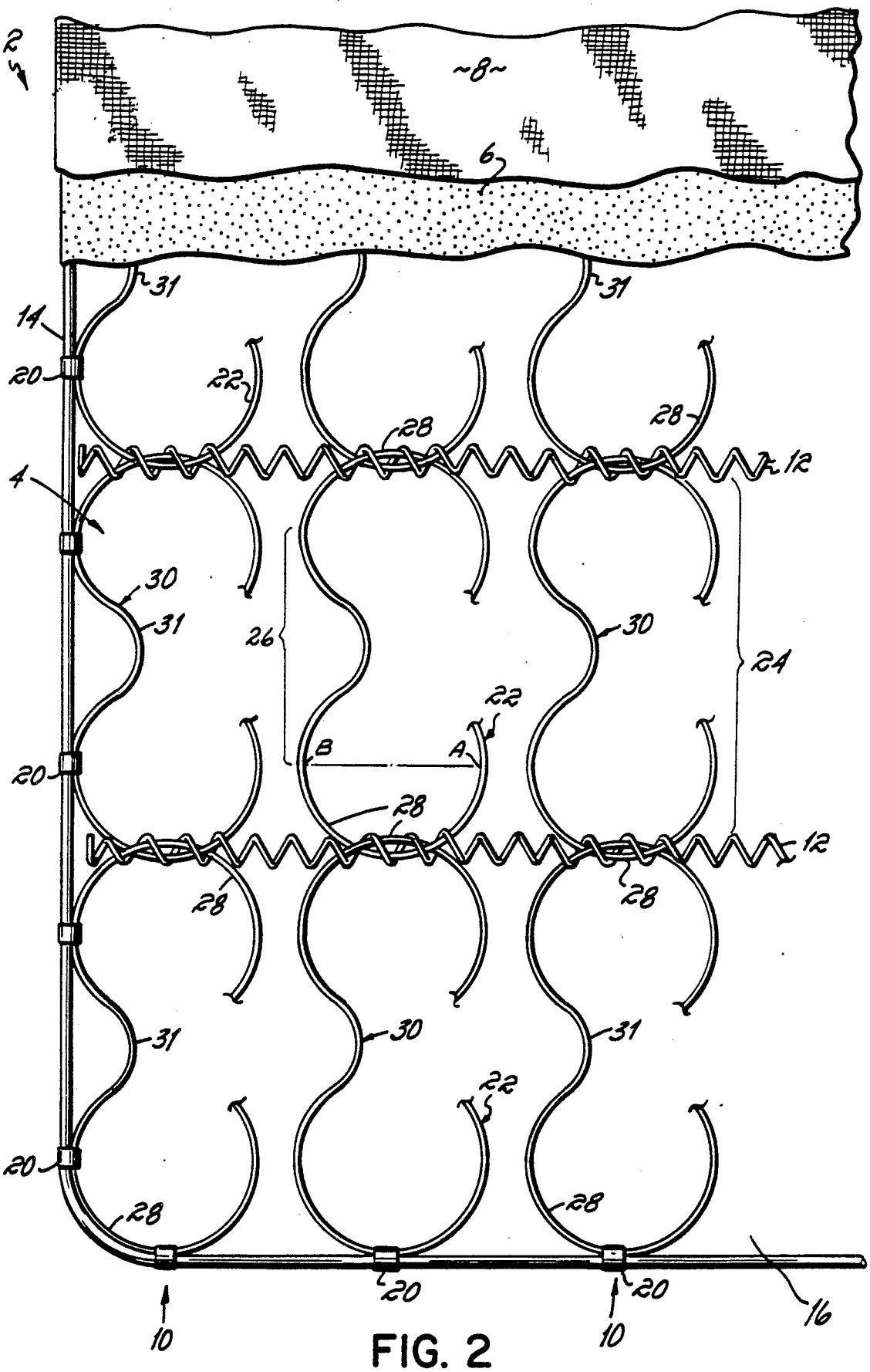
FIG. 2 is an enlarged top plan view of a corner portion of the mattress of FIG. 1, illustrating particularly planar portions of the interconnecting segments of the bands of coil springs.
Figure 3:
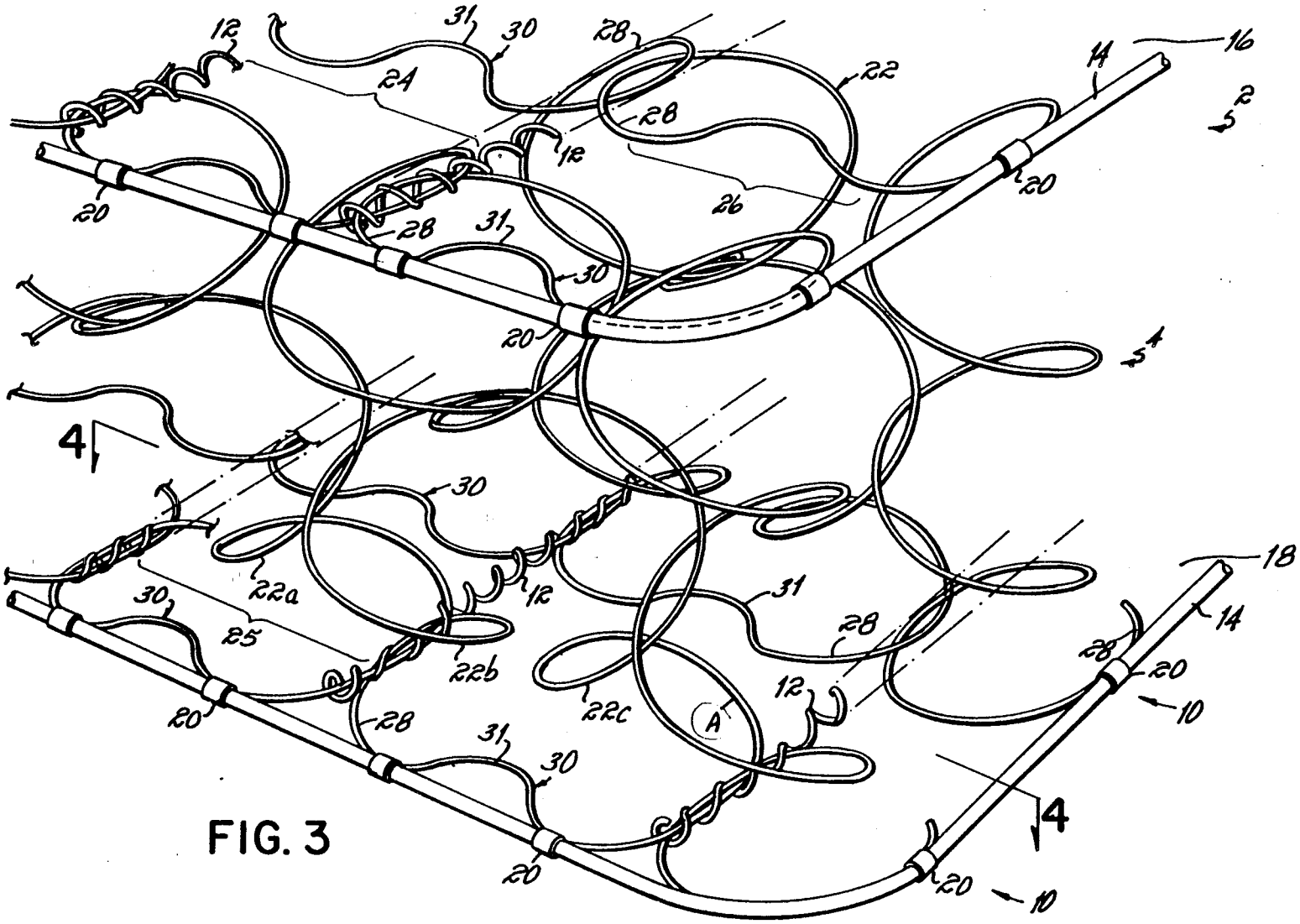
FIG. 3 is a perspective view of the corner portion of the spring interior illustrated in FIG. 2.

With reference first to FIGS. 1–3, there is illustrated a mattress 2 embodying the invention of this application. This mattress comprises a spring interior 4 on the top and bottom surfaces of which there is a pad 6. An upholstered covering 8 encases the spring interior 4 and the pads 6.

The spring interior 4 is formed from a plurality of bands of springs 10 which extend longitudinally of the mattress. These bands of springs 10 are laced together by helical lacing wires 12 which extend transversely of the spring interior and secure the bands of springs in an assembled relation. A border wire 14 extends completely around the periphery of the spring interior in the top and bottom planes 16, 18 (see FIG. 3), respectively, of the interior and is secured to the outermost edge of the spring interior in these planes by conventional sheet metal clips 20.

Figure 4:
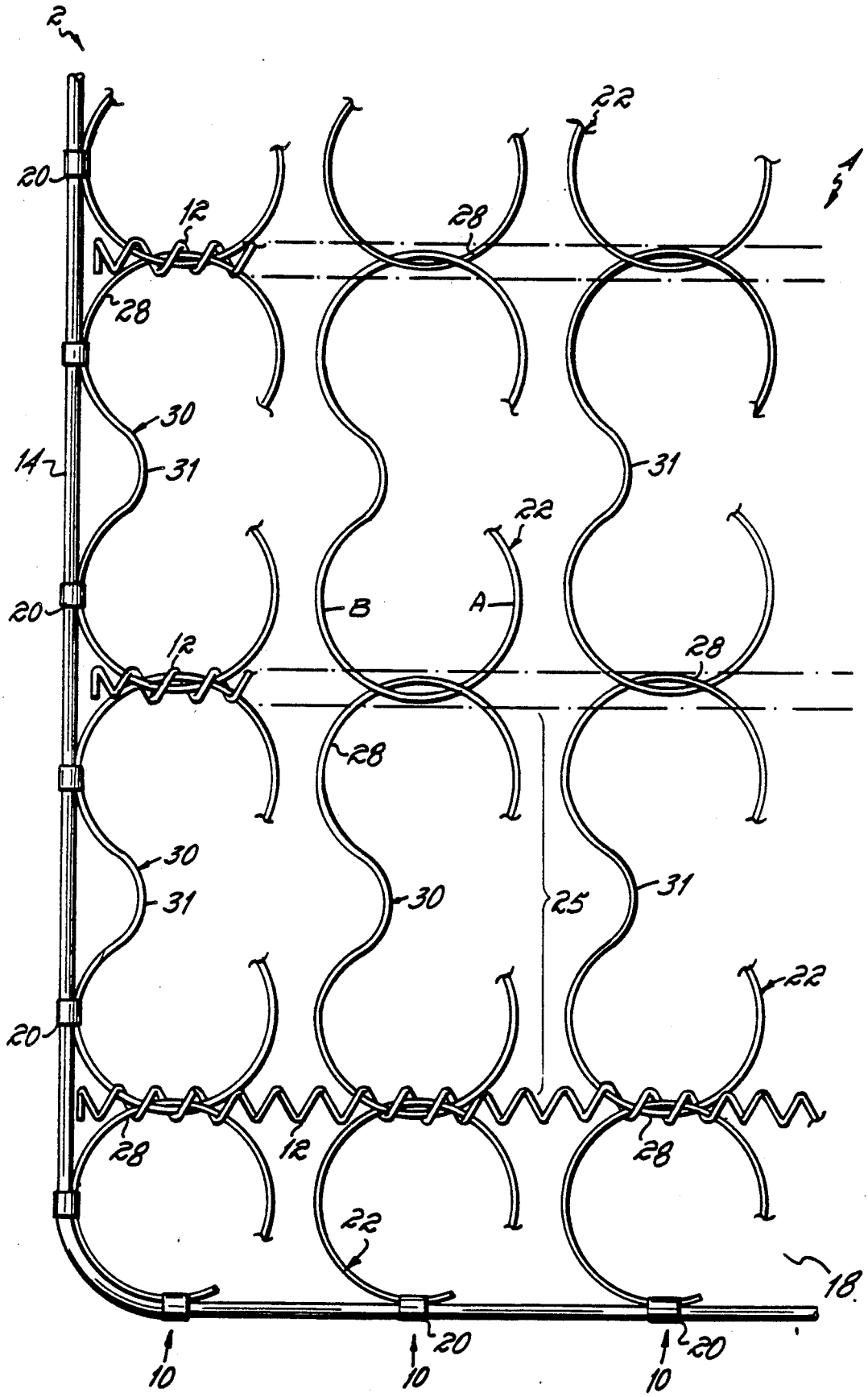
FIG. 4 is a bottom plan view of the same corner illustrated in FIG. 2.

Each band of springs 10, a portion of one of which is illustrated in FIGS. 2 and 4, is made from a single length of spring wire shaped to form a plurality of individual coil springs 22 arranged in a row. Each coil spring 22 comprises about two and one-half turns of wire. The axis of each coil spring is not upright but is inclined slightly lengthwise of the band, each spring being inclined in a direction opposite to that in which its two adjacent springs in the row are inclined. The end turns of the coil springs 22 lie adjacent to the top and bottom faces 16, 18 of the band. Each coil spring, such as that numbered 22*b* (FIG. 3), is so coiled as to have a hand opposite to the hand of the adjacent coil springs, such as 22*a* and 22*c*, immediately before and after it in the row. Each coil spring is joined to the next adjacent coil spring by two interconnecting segments 24, 25 (FIG. 3) of the wire integral with the coil springs. One of the two interconnecting segments 24, 25 is in the top face 16 of the band 10, and the other is in the bottom face 18 thereof. For example, coil spring 22*a* (FIG. 3) is connected to coil spring 22*b* by interconnecting segment 24, which is in the top face of the band, and the coil spring 22*b* is connected to coil spring 22*c* by interconnecting segment 25, which is in the bottom face of the band. Each interconnecting segment 24, 25 comprises a bridging portion 26 (FIG. 2), which extends generally longitudinally of the row of coil springs and planar end sections 28 which extend in a direction generally normal to the longitudinal axis of the band 10. Those planar end sections 28 of the interconnecting segments 24, 25 also lie in the top and bottom faces 16, 18 of the band 10.

In the bands 10 illustrated in FIGS. 1–4, the location of the intersection A between each end of each coil spring 22*a*, 22*b*, or 22*c* and the associated planar arcuate end section 28 of the interconnecting segments 24, 25 is not well defined, because the arcuate end section 28 maintains approximately the same radius as the coil spring 22 up to the intersection of the arcuate end section 28 with the bridging portion 26. In accordance with this invention the arcuate end section 28 of the interconnecting segments 24, 25 has at least 90° and preferably approximately 180° (FIG. 2) of its arc A-B in the top or bottom planes, 16, 18, respectively, and extends generally transverse of the row 10.

Although the arcuate end sections 28 are less well defined than would be straight end sections, the advantages are less wire used to make the interconnecting segments, increased production rate, and simplified manufacturing machinery. In addition, by using arcuate end sections rather than straight or substantially straight end sections, the heads of each coil spring are smaller, and thus a greater coil density is achievable if desired.

Each bridging portion 26, in addition to extending generally longitudinally of the band, also extends generally laterally thereof to form a supporting structure 30. In the embodiment of FIGS. 1–4, the supporting structure 30 is in the form of a generally V-shaped indentation 31 of wire lying in the top 16 or bottom face 18 of the band 10, as the case may be, and extending to one side of the remainder of the bridging portion 26 of which it forms a part. Each V-shaped indentation 31 lies halfway between the arcuate end sections 28 of the interconnecting segment of which it forms a part, and it extends from one side face of the band toward the other side face thereof.

The method of manufacturing and the apparatus for manufacturing the band of springs illustrated in FIGS. 1–4 is completely described and illustrated in British Patent No. 2,143,731. After the rows of coil springs are formed, each coil spring is interlaced with the next by having an intermediate turn thereof passed around an intermediate turn of the next spring. This coupling or interlacing can be carried out mechanically or manually.

A plurality of bands of springs 10 are assembled to form a spring interior 4. Bands of springs 10, each similar to that shown in FIGS. 1–4, are disposed side by side, and preformed helical wires 12 are attached to them. The helical wires 12 lie in the top and bottom faces 16, 18 of the bands and extend at right angles to the longitudinal axes of the bands. Each helical wire 12 embraces one pair of closely adjacent overlapped arcuate end sections 28 by making three full turns or revolutions of the helical lacing wires 12 about the overlapped end sections 28 of adjacent interconnecting segments of each band 10 of coil springs of each band.

While we have described only one embodiment in our invention, persons skilled in the art to which it applies will appreciate changes and modifications which may be made without departing from the spirit of my invention. Therefore, we do not intend to be limited except by the scope of the following appended claims.

We claim:

1. A bedding mattress comprising a spring interior having a plurality of bands of springs extending longitudinally of the spring interior, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to the adjacent coil springs by interconnecting segments integral with the coil springs, one of said interconnecting segments being located substantially in the top face of the band and the other of said interconnecting segments being located substantially in the bottom face of the band, each interconnecting segment comprising a bridging portion which extends generally lengthwise of the row and end sections which extend generally transversely of the row, each end section comprising an arcuate portion of approximately the same radius as the coil springs and each arcuate portion having at least 90 degrees of its arc located in the face of the band, the bands being disposed side by side so that their top faces lie in a top main face of the spring interior and their bottom faces lie in a bottom main face of the spring interior, the bands being interconnected by helical lacing wires lying in the top and bottom faces of the bands and extending transversely across the bands, each helical lacing wire embracing the arcuate portions that extend generally transversely of the bands from the ends of said bridging portions thereof.

2. A spring interior comprising a plurality of bands of springs extending longitudinally of the spring interior, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end sections which extend generally transversely of the row, each end section comprising an arcuate portion of wire of approximately the same radius as the coil spring to which it is connected, each arcuate portion having at least 90 degrees of its arc located in the face of the band, the bands being disposed side by side so that their top faces lie in a top main face of the spring interior and their bottom faces lie in a bottom main face of the spring interior, the bands being interconnected by helical lacing wires lying in the top and bottom faces of the bands and extending transversely across the bands, each helical lacing wire embracing the arcuate portions that extend generally transversely of the bands from the ends of said bridging portions thereof.

3. A spring interior comprising a plurality of bands of springs extending longitudinally of the spring interior, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interfaced with the adjacent coil springs of the same row, each coil spring being joined to said adjacent coil springs by interconnecting segments integral with the coil springs, one of said interconnecting segments being located substantially in the top face of the band and other of said interconnecting segments being located substantially in the bottom face of the band, each interconnecting segment comprising a bridging portion which extends generally lengthwise of the row and an end section which extends generally transversely of the row, each end section comprising an arcuate portion of wire extending for substantially the full length of the end section and being of approximately the same radius as the coil spring to which it is connected.

4. The spring interior of claim 3 wherein each arcuate portion of each interconnecting segment has at least 90 degrees of its arc located in the face of the band, the bands being disposes side by side so that their top faces lie in a top main face of the spring interior and their bottom faces lie in a bottom main face of the spring interior, and the bands being interconnected by helical lacing wires lying in the top and bottom faces of the bands and extending transversely across the bands.

5. A spring interior comprising a plurality of longitudinally extending bands of springs disposed side by side and connected together in the top and bottom faces of the bands, each of said bands of springs comprising a single length of wire formed in a plurality of substantially vertical coil springs arranged in a row and interconnected by interconnecting segments of wire located alternately in the top and bottom faces of the bands, each interconnecting segment comprising a bridging portion which extends generally lengthwise of the row and end sections which extend generally transversely of the row, each end section comprising an arcuate portion of wire which is arcuate for substantially the full length of the end section and which is of approximately the same radius as the coil springs, the bands being interconnected by helical lacing wires lying in the top and bottom faces of the bands and extending transversely across the bands, and each helical lacing wire embracing overlapping arcuate portions of the bands.

6. The spring interior of claim 5 wherein the lacing wires make three full wraps about the overlapped arcuate portions of end sections of said spring interior.

7. The spring interior of claim 5 wherein each arcuate end section extends through an arc of at least 90° in the face of the band.

8. A spring interior comprising a plurality of bands of springs extending longitudinally of the spring interior, each band of springs comprising a single length of wire shaped to form a plurality of individual coil springs arranged in a row, one end turn of each coil spring lying adjacent to a top face of the band and the other end turn of each coil spring lying adjacent to a bottom face of the band, each coil spring being of a hand opposite to the hand of the adjacent coil springs immediately before and after it in the row and being interlaced with the adjacent coil springs of the same row, each coil spring being joined to said adjacent coil springs by interconnecting segments integral with the coil springs, one of said interconnecting segments being located substantially in the top face of the band and the other of said interconnecting segments being located substantially in the bottom face of the band, and each interconnecting segment comprising a bridging portion which extends lengthwise of the row and end sections which extend generally transversely of the row, each end section consisting of an arcuate portion of wire of approximately the same radius as the coil spring to which it is connected, each arcuate portion having at least 90 degrees of its arc located in the face of the band, the bands being disposed side by side so that their stop faces lie in a top main face of the spring interior and their bottom faces lie in a bottom main face of the spring interior, the bands being interconnected by helical lacing wires lying in the top and bottom faces of the bands and extending transversely across the band, each helical lacing wire embracing the arcuate portions that extend generally transversely of the bands from the ends of said bridging portions thereof.

* * * * *

UNITED STATES PATENT AND TRADEMARK OFFICE

CERTIFICATE OF CORRECTION

PATENT NO. : 5,104,099

DATED : April 14, 1992

INVENTOR(S) : Thomas P. Long

It is certified that error appears in the above-identified patent and that said Letters Patent is hereby corrected as shown below:

Column 6, line 12, "interfaced" should be --interlaced--.

Column 6, line 17, after "and" and before "other", insert --the--.

Column 6, line 30, change "disposes" to --disposed--.

Column 8, line 4, "stop" should be --top--.

Signed and Sealed this

Nineteenth Day of October, 1993

Bruce Lehman

*Attest:*

BRUCE LEHMAN

*Attesting Officer*

*Commissioner of Patents and Trademarks*